US008594531B2

(12) United States Patent
Miki et al.

(10) Patent No.: US 8,594,531 B2
(45) Date of Patent: Nov. 26, 2013

(54) SHAFT MEMBER HOLDING MECHANISM, PHOTOCONDUCTOR DRUM UNIT AND IMAGE FORMING APPARATUS

(75) Inventors: Masafumi Miki, Osaka (JP); Chisato Hatakeyama, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 273 days.

(21) Appl. No.: 13/051,020

(22) Filed: Mar. 18, 2011

(65) Prior Publication Data

US 2011/0236061 A1 Sep. 29, 2011

(30) Foreign Application Priority Data

Mar. 24, 2010 (JP) ..... 2010-068446

(51) Int. Cl.
*G03G 15/00* (2006.01)

(52) U.S. Cl.
USPC ..... 399/117; 384/495

(58) Field of Classification Search
USPC ..... 399/117, 167; 384/490, 495, 498
See application file for complete search history.

(56) References Cited

U.S. PATENT DOCUMENTS 1,931,723 A * 10/1933 Fageol et al. ..... 277/392
4,412,705 A * 11/1983 Schreiner et al. ..... 384/584
4,512,673 A * 4/1985 Condon et al. ..... 384/569
5,017,024 A * 5/1991 Clark et al. ..... 384/482
5,385,413 A * 1/1995 Murphy et al. ..... 384/564
6,385,417 B1 * 5/2002 Tanaka et al. ..... 399/164
7,334,515 B2 * 2/2008 Suzuki et al. ..... 92/72
7,628,542 B2 * 12/2009 Wada et al. ..... 384/535

FOREIGN PATENT DOCUMENTS

JP 2003-74573 A 12/2003
JP 2005-189751 A 7/2005
JP 2006-103391 A 4/2006

OTHER PUBLICATIONS

English Machine Translation of JP-2003-74573 A.
Notice of Reasons for Rejection issued to Japanese Patent Application No. 2010-068446, mailed Mar. 27, 2012.

* cited by examiner

*Primary Examiner* — Robert Beatty

(57) ABSTRACT

A shaft member holding mechanism comprising: a shaft member arranged rotatably about a rotation axis; a bearing that supports the shaft member rotatably, including an outer ring portion, and an inner ring portion that holds the shaft member and is arranged at an inside of the outer ring portion so that the inner ring portion can rotate relatively to the outer ring portion; a holding member having a bearing holding portion that holds the outer ring portion of the bearing in a state where a rotation of the outer ring portion is regulated; and an inclination suppression member that is arranged at one side of the bearing in the rotation axis direction of the bearing and suppresses the bearing from inclining.

8 Claims, 9 Drawing Sheets

SHAFT MEMBER HOLDING MECHANISM, PHOTOCONDUCTOR DRUM UNIT AND IMAGE FORMING APPARATUS

This application is based on and claims the benefit of priority from Japanese Patent Application No. 2010-068446, filed on Mar. 24, 2010, the content of which is incorporated herein by reference.

BACKGROUND OF THE INVENTION

1. Field of the Invention

The present invention relates to a shaft member holding mechanism that holds a shaft member rotatably, a photoconductor drum unit including the shaft member holding mechanism, and an image forming apparatus including the photoconductor drum unit.

2. Related Art

Conventionally, there are image forming apparatuses such as printers and copiers that have photoconductor drums. The photoconductor drum includes a photoconductor drum body and a shaft member arranged at both ends of the photoconductor drum body. In addition, the shaft member of the photoconductor drum is held rotatably about a predetermined rotation axis by a holding portion (holding mechanism) formed on the apparatus body side.

As the mechanism that holds (supports) the shaft member in the photoconductor drum, for example, a mechanism is proposed in which the shaft member in the photoconductor drum is held rotatably by a bearing.

However, in the above mechanism, when the user installs the bearing to a predetermined holding member in a state where the bearing has been installed to the shaft member, there are cases where the bearing is attached to the holding member in a state where the angle to the rotation axis is different from a desired angle (angle of initial setting).

In particular, in cases where the bearing is arranged at a position spaced apart a predetermined distance inside (center side of shaft) from the end of the shaft member, or cases where the position (position of the portion holding a bearing) in the holding member where the bearing is attached to is located at the back side in the insertion direction of the bearing, there were times when installing the bearing at a desired angle (for example, vertical) to the rotation axis of the shaft member (photoconductor drum) was difficult.

SUMMARY OF THE INVENTION

An object of the present invention is to provide a shaft member holding mechanism that holds the shaft member rotatably, wherein the bearing is held at a desired angle to the rotation axis.

In addition, an object of the present invention is to provide a photoconductor drum unit including the shaft member holding mechanism.

In addition, an object of the present invention is to provide an image forming apparatus including the photoconductor drum unit.

The present invention relates to a shaft member holding mechanism comprising:

a shaft member arranged rotatably about a rotation axis;

a bearing that supports the shaft member rotatably, including an outer ring portion, and an inner ring portion that holds the shaft member and is arranged at an inside of the outer ring portion so that the inner ring portion can rotate relatively to the outer ring portion;

a holding member having a bearing holding portion that holds the outer ring portion of the bearing in a state where a rotation of the outer ring portion is regulated; and an inclination suppression member that is arranged at one side of the bearing in the rotation axis direction of the bearing and suppresses the bearing from inclining.

The present invention relates to a photoconductor drum unit comprising:

a shaft member holding mechanism according to claim 1; and a photoconductor drum body arranged at an opposite side of the bearing at the shaft member from the inclination suppression member side.

The present invention relates to an image forming apparatus comprising:

a photoconductor drum unit according to claim 11;

a transfer portion which transfers a toner image formed on a surface of the photoconductor drum body to a transfer material of a sheet material; and a fixing unit which fixes onto the transfer material the toner image transferred by the transfer portion.

The present invention relates to a shaft member holding mechanism comprising:

a shaft member;

a bearing which supports the shaft member rotatably, including an outer ring portion, and an inner ring portion that holds the shaft member and is arranged inside the outer ring portion such that the inner ring portion can rotate relatively to the outer ring portion;

a holding member including a bearing holding portion that holds the outer ring portion in the bearing; and an inclination suppression member arranged to contact with the bearing at one side of the bearing in a rotation axis direction.

According to the present invention, it is possible to provide a shaft member holding mechanism which holds a shaft member rotatably, and where the bearing is held at a desired angle from the rotation axis.

In addition, according to the present invention, it is possible to provide a photoconductor drum unit including the shaft member holding mechanism.

Furthermore, according to the present invention, it is possible to provide an image forming apparatus including the photoconductor drum unit.

DETAILED DESCRIPTION OF THE INVENTION

Hereafter, embodiments of the image forming apparatus according to the present invention will be described with reference to the drawings.

Figure 1:
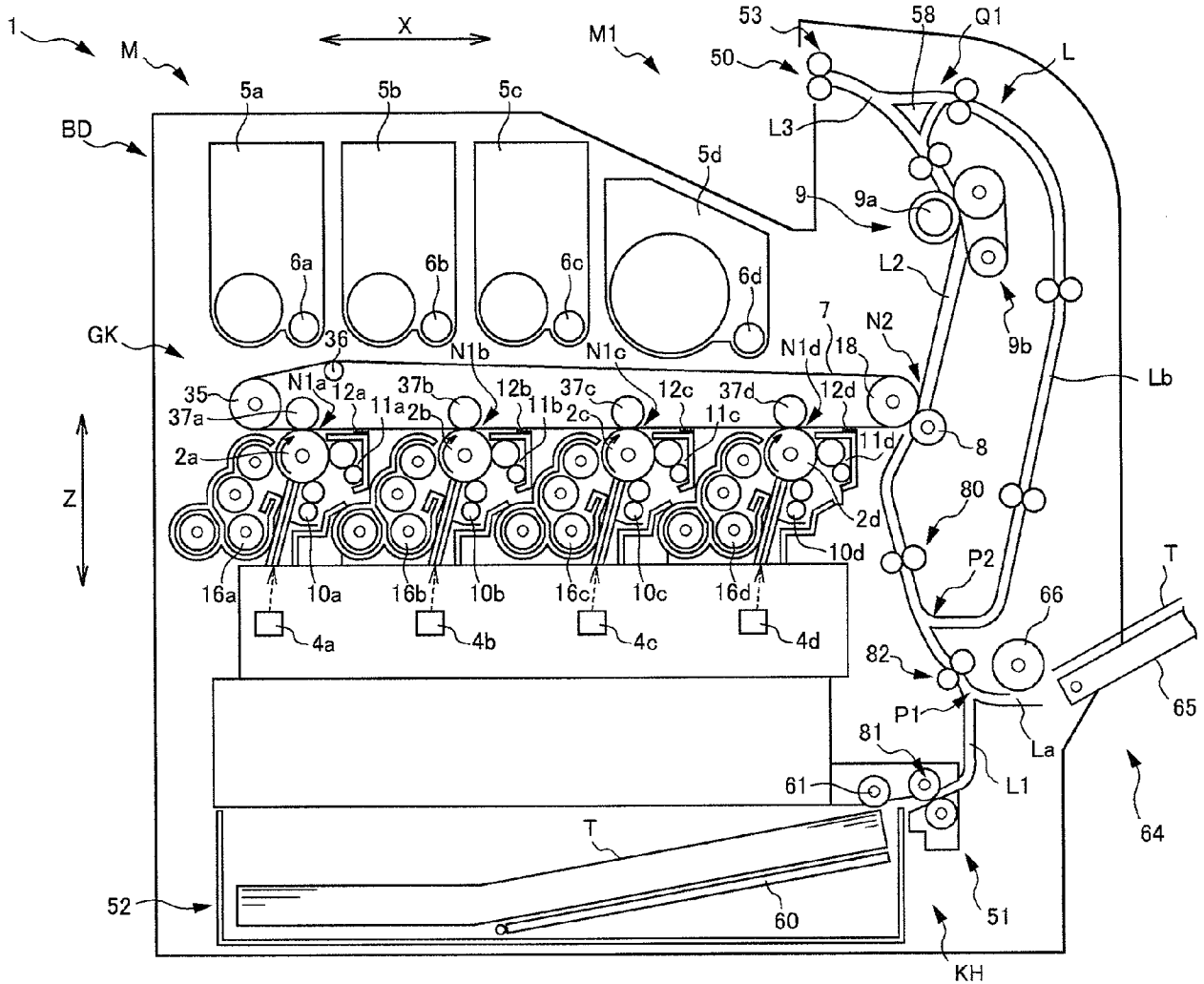
FIG. 1 is a front view for illustrating an arrangement of components in a printer.

The entire structure of a printer 1 serving as the image forming apparatus will be described with reference to FIG. 1. FIG. 1 is a front view for illustrating an arrangement of the components in the printer 1.

In the following description, "direction X" is assigned to left and right directions, "direction Y" is assigned to front and back (depth) directions, and "direction Z" is assigned to up and down directions, when viewed from the perspective of a user standing in front of the printer 1.

As shown in FIG. 1, the printer 1 serving as the image forming apparatus includes: a device body M; an image forming unit GK that forms a toner image onto a paper T that serves as a sheet-like transfer material based on predetermined image information; and a paper feed and discharge unit KH that feeds the paper T to the image forming unit GK and discharges the paper T on which the toner image has been formed.

An external form of the device body M is configured by a case body BD serving as a housing.

As shown in FIG. 1, the image forming unit GK includes: photoconductor drums 2*a*, 2*b*, 2*c* and 2*d* serving as image carriers (photoconductor); electrification units 10*a*, 10*b*, 10*c* and 10*d*; laser scanner units 4*a*, 4*b*, 4*c* and 4*d* serving as exposure units; development units 16*a*, 16*b*, 16*c* and 16*d*; toner cartridges 5*a*, 5*b*, 5*c* and 5*d*; toner feed units 6*a*, 6*b*, 6*c* and 6*d*; drum cleaning units 11*a*, 11*b*, 11*c* and 11*d*; electricity removal units 12*a*, 12*b*, 12*c* and 12*d*; an intermediate transfer belt 7, primary transfer rollers 37*a*, 37*b*, 37*c* and 37*d*; a secondary transfer roller 8; an opposed roller 18; and a fixing unit 9.

As shown in FIG. 1, the paper feed and discharge unit KH includes: a paper feeding cassette 52; a manual feeding unit 64; a carrier path L of the paper T; a resist roller pair 80; a plurality of rollers or roller pairs; and a paper discharge unit 50. It should be noted that the carrier path L is an aggregate of a first carrier path L1, a second carrier path L2, a third carrier path L3, a manual carrier path La, and a return carrier path Lb, as described later.

Hereafter, structures of the image forming unit GK and the paper feed and discharge unit KH will be described in detail.

First, the image forming unit GK will be described.

In the image forming unit GK, when the photoconductor drums 2*a*, 2*b*, 2*c* and 2*d* rotate at the time of image forming, for each surface of the photoconductor drums 2*a*, 2*b*, 2*c* and 2*d*, the electrification by the electrification units 10*a*, 10*b*, 10*c* and 10*d*, the exposure by the laser scanner units 4*a*, 4*b*, 4*c* and 4*d*, the development by the development units 16*a*, 16*b*, 16*c* and 16*d*, the primary transfer by the intermediate transfer belt 7 and the primary transfer rollers 37*a*, 37*b*, 37*c* and 37*d*, the electricity removal by the electricity removal units 12*a*, 12*b*, 12*c* and 12*d*, and the cleaning by the drum cleaning units 11*a*, 11*b*, 11*c* and 11*d* are performed sequentially.

In addition, in the image forming unit GK, a secondary transfer by the intermediate transfer belt 7, the secondary transfer roller 8 and the opposed roller 18, and the fixing by the fixing unit 9 are performed also.

The photoconductor drums 2*a*, 2*b*, 2*c* and 2*d* respectively include: photoconductor drum bodies 150*a* (refer to FIG. 2), 150*b*, 150*c* and 150*d* having cylindrical shapes; first shaft members 120*a* (refer to FIG. 2), 120*b*, 120*c* and 120*d* arranged on one end side of the photoconductor drum bodies 150*a*, 150*b*, 150*c* and 150*d*; and second shaft members 140*a* (refer to FIG. 2), 140*b*, 140*c* and 140*d* arranged on the other end side. Here, in the present embodiment, the photoconductor drums 2*a*, 2*b*, 2*c* and 2*d* include third shaft members 125*a* (refer to FIG. 2), 125*b*, 125*c* and 125*d*, respectively, which connect between the first shaft members 120*a*, 120*b*, 120*c* and 120*d*, and the second shaft members 140*a*, 140*b*, 140*c* and 140*d*, respectively. Each of the photoconductor drums 2*a*, 2*b*, 2*c* and 2*d* has one shaft member in which the first shaft members 120*a*, 120*b*, 120*c* and 120*d*, the third shaft members 125*a*, 125*b*, 125*c* and 125*d*, and the second shaft members 140*a*, 140*b*, 140*c* and 140*d* are respectively continuously formed integrally.

Each of the photoconductor drum bodies 150*a*, 150*b*, 150*c* and 150*d* functions as a photoconductor or an image supporter.

The first shaft members 120*a*, 120*b*, 120*c* and 120*d* are held rotatably by first holding members 200*a* (refer to FIG. 2), 200*b*, 200*c* and 200*d* and second holding members 300*a* (refer to FIG. 2), 300*b*, 300*c* and 300*d*, respectively. Specifically, the first shaft members 120*a*, 120*b*, 120*c* and 120*d* are held rotatably by first bearings 250*a*, 250*b*, 250*c* and 250*d*, respectively, which are held by the first holding members 200*a*, 200*b*, 200*c* and 200*d*, respectively. Furthermore, the first shaft members 120*a*, 120*b*, 120*c* and 120*d* are held rotatably by second bearings (end side bearings) 350*a* (refer to FIG. 3), 350*b*, 350*c* and 350*d*, respectively, which are held by the second holding members 300*a*, 300*b*, 300*c* and 300*d*, respectively.

Each of the second shaft members 140*a*, 140*b*, 140*c* and 140*d* is joined to a photoconductor drum drive unit 500 directly or indirectly through a joint member.

The rotational driving force is transmitted from the photoconductor drum drive unit 500 to each of the second shaft members 140*a*, 140*b*, 140*c* and 140*d*.

Here, as described above, since the first shaft members 120*a*, 120*b*, 120*c* and 120*d* are respectively held rotatably by the first bearings 250*a*, 250*b*, 250*c* and 250*d*, and the second holding members 300*a*, 300*b*, 300*c* and 300*d*, the photoconductor drums 2*a*, 2*b*, 2*c* and 2*d* are respectively rotated about a rotation axis R (refer to FIG. 4) by the rotational driving force transmitted from the photoconductor drum drive unit 500.

Because of the above, the photoconductor drums 2*a*, 2*b*, 2*c* and 2*d* are respectively arranged rotatably in the direction of arrows shown in FIG. 1 about the rotation axes R (refer to FIG. 4) extending in the direction intersecting orthogonally to the moving direction of the intermediate transfer belt 7. An electrostatic latent image may be formed on each surface of the photoconductor drums 2*a*, 2*b*, 2*c* and 2*d*.

Figure 2:
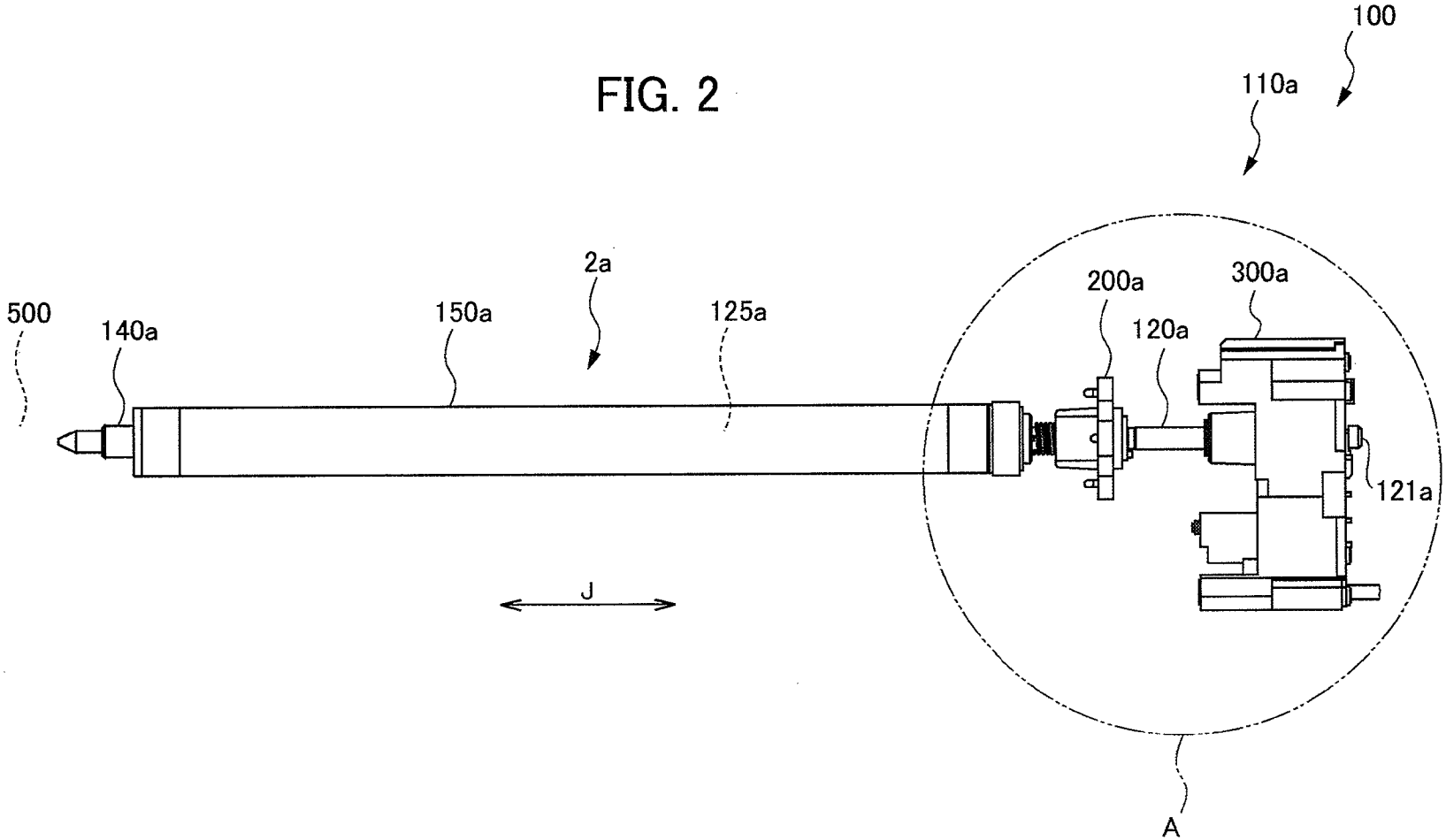
FIG. 2 is a drawing illustrating a state where a photoconductor drum is held rotatably by a first holding member and a second holding member.

Here, the photoconductor drums 2*a*, 2*b*, 2*c* and 2*d* are formed as a unit and are arranged integrally in the photoconductor drum unit 100 (refer to FIG. 2).

The photoconductor drum unit 100 is configured to include the shaft member holding mechanisms 110*a* (refer to FIG. 2), 110*b*, 110*c* and 110*d*, which are configured to include the first shaft members 120*a*, 120*b*, 120*c* and 120*d* and the first bearings 250*a*, 250*b*, 250*c* and 250*d*. The shaft member holding mechanisms 110*a*, 110*b*, 110*c* and 110*d* and the photoconductor drum unit 100 will be described later.

The electrification units 10*a*, 10*b*, 10*c* and 10*d* are respectively arranged to face the surface of the photoconductor drums 2*a*, 2*b*, 2*c* and 2*d*, respectively. The electrification units 10*a*, 10*b*, 10*c* and 10*d* positively charge (positive polarity) the surface of the photoconductor drums 2*a*, 2*b*, 2*c* and 2*d*, respectively.

The laser scanner units 4*a*, 4*b*, 4*c* and 4*d* functions as exposure units and are arranged to be spaced apart from the surfaces of the photoconductor drums 2*a*, 2*b*, 2*c* and 2*d*, respectively. Each of the laser scanner units 4*a*, 4*b*, 4*c* and 4*d* is configured to include a laser light source, a polygon mirror, a motor for driving the polygon mirror, and the like, which are not illustrated.

The laser scanner units 4*a*, 4*b*, 4*c* and 4*d* scan and expose the surfaces of the photoconductor drums 2*a*, 2*b*, 2*c* and 2*d*, respectively, based on the image information inputted from external devices such as a PC (personal computer). The charge at the exposed portions on the surfaces of the photoconductor drums 2*a*, 2*b*, 2*c* and 2*d* are removed by being scanned and exposed by the laser scanner units 4*a*, 4*b*, 4*c* and 4*d*, respectively. Thereby, the electrostatic latent images are respectively formed on the surfaces of the photoconductor drums 2*a*, 2*b*, 2*c* and 2*d*.

The development units 16*a*, 16*b*, 16*c* and 16*d* are respectively provided to correspond with the photoconductor drums 2*a*, 2*b*, 2*c* and 2*d*, and face the surfaces of the photoconductor drums 2*a*, 2*b*, 2*c* and 2*d*. The development units 16*a*, 16*b*, 16*c* and 16*d* respectively make the toner for each color adhere to the part where the electrification charge of the electrostatic latent images formed on the surfaces of the photoconductor drums 2*a*, 2*b*, 2*c* and 2*d* are removed, and form color toner images on the surfaces of the respective photoconductor drums 2*a*, 2*b*, 2*c* and 2*d*. The development units 16*a*, 16*b*, 16*c* and 16*d* correspond to the four colors, which are yellow, cyan, magenta, and black. Each of the development units 16*a*, 16*b*, 16*c* and 16*d* is configured to include a developing roller, an agitating roller for agitating the toner, and the like, that are arranged to face the surface of each of the photoconductor drums 2*a*, 2*b*, 2*c* and 2*d*.

The toner cartridges 5*a*, 5*b*, 5*c* and 5*d* are respectively provided to correspond with the development units 16*a*, 16*b*, 16*c*, and 16*d*, and to house the toner for each color that is to be supplied to the development units 16*a*, 16*b*, 16*c* and 16*d*, respectively. The toner cartridges 5*a*, 5*b*, 5*c* and 5*d* house the yellow toner, the cyan toner, the magenta toner, and the black toner, respectively.

The toner feed units 6*a*, 6*b*, 6*c* and 6*d* are respectively provided to correspond with the toner cartridges 5*a*, 5*b*, 5*c* and 5*d* and the development units 16*a*, 16*b*, 16*c* and 16*d*, and feed the toners for each color housed in the toner cartridges 5*a*, 5*b*, 5*c* and 5*d* to the development units 16*a*, 16*b*, 16*c* and 16*d*, respectively.

The toner images for each color formed on the photoconductor drums 2*a*, 2*b*, 2*c* and 2*d* are sequentially subjected to the primary transfer onto the intermediate transfer belt 7. The intermediate transfer belt 7 is hung on a driven roller 35, the opposed roller 18 that functions as the drive roller, a tension roller 36, and the like. Since the tension roller 36 presses the intermediate transfer belt 7 from the inside to the outside, a predetermined tension is provided to the intermediate transfer belt 7.

On the opposite side of the intermediate transfer belt 7 from the photoconductor drums 2*a*, 2*b*, 2*c* and 2*d*, the primary transfer rollers 37*a*, 37*b*, 37*c* and 37*d* are respectively arranged to face the photoconductor drums 2*a*, 2*b*, 2*c* and 2*d*.

The intermediate transfer belt 7 is sandwiched by the primary transfer rollers 37*a*, 37*b*, 37*c* and 37*d* and the photoconductor drums 2*a*, 2*b*, 2*c* and 2*d*, respectively. The sandwiched portions are pressed onto the surfaces on the photoconductor drums 2*a*, 2*b*, 2*c* and 2*d*. Primary transfer nips N1*a*, N1*b*, N1*c* and N1*d* are formed between the photoconductor drums 2*a*, 2*b*, 2*c* and 2*d* and the primary transfer rollers 37*a*, 37*b*, 37*c* and 37*d*, respectively. In each of the primary transfer nips N1*a*, N1*b*, N1*c* and N1*d*, the toner image for each color formed on each of the photoconductor drums 2*a*, 2*b*, 2*c* and 2*d* is subjected to the primary transfer onto the intermediate transfer belt 7 sequentially. Thereby, a full color toner image is formed on the intermediate transfer belt 7.

The primary transfer bias for causing the toner image for each color formed on the photoconductor drums 2*a*, 2*b*, 2*c* and 2*d* to be transferred onto the intermediate transfer belt 7 is applied by the primary transfer bias application unit, which is not illustrated, to each of the primary transfer rollers 37*a*, 37*b*, 37*c* and 37*d*.

The electricity removal units 12*a*, 12*b*, 12*c* and 12*d* are arranged to face the surfaces of the photoconductor drums 2*a*, 2*b*, 2*c* and 2*d*, respectively. The electricity removal units 12*a*, 12*b*, 12*c* and 12*d* respectively remove electricity (remove electric charge) from the surfaces of the photoconductor drums 2*a*, 2*b*, 2*c* and 2*d* after they have been subjected to the primary transfer by irradiating light onto the surfaces of the photoconductor drums 2*a*, 2*b*, 2*c* and 2*d*, respectively.

The drum cleaning units 11*a*, 11*b*, 11*c* and 11*d* are respectively arranged to face the surfaces of the photoconductor drums 2*a*, 2*b*, 2*c* and 2*d*. The drum cleaning units 11*a*, 11*b*, 11*c* and 11*d* respectively remove toners and extraneous matter that remain on the surfaces of the photoconductor drums 2*a*, 2*b*, 2*c* and 2*d* after the primary transfer, and convey the removed toners and the like to a predetermined recovery mechanism for collection, as well.

The secondary transfer roller 8 makes a full color toner image that has been subjected to the primary transfer onto the intermediate transfer belt 7 to be subjected to the secondary transfer onto the paper T. Secondary transfer bias for making the full color toner image formed on the intermediate transfer belt 7 transfer onto the paper T is applied to the secondary transfer roller 8 by the secondary transfer bias application unit that is not illustrated.

The secondary transfer roller 8 is brought into contact with and is spaced apart from the intermediate transfer belt 7. Specifically, the secondary transfer roller 8 is arranged to be movable between a contact position where it contacts with the intermediate transfer belt 7 and a spaced apart position where it is spaced apart from the intermediate transfer belt 7. In detail, the secondary transfer roller 8 is arranged at the contact position when making the full color toner image that has been subjected to the primary transfer onto the intermediate transfer belt 7 to be subjected to the secondary transfer onto the paper T, and is arranged at the spaced apart position in other times.

The opposed roller 18 is arranged on an opposite side of the intermediate transfer belt 7 from the secondary transfer roller 8. The intermediate transfer belt 7 is sandwiched by the secondary transfer roller 8 and the opposed roller 18. Then, the paper T is pressed onto the outside surface (the surface where the toner image has been subjected to the primary transfer) of the intermediate transfer belt 7. A secondary transfer nip N2 is formed between the intermediate transfer belt 7 and the secondary transfer roller 8. In the secondary transfer nip N2, the full color toner image that has been subjected to the primary transfer onto the primary intermediate transfer belt 7 is subjected to the secondary transfer onto the paper T.

The fixing unit 9 fixes onto the paper T the toner for each color that configures the toner image that has been subjected to the secondary transfer onto the paper T. The fixing unit 9 includes a heating rotor 9*a* which is heated with a heater, and a pressing rotor 9*b* which is brought into pressurized contact with the heating rotor 9*a*. The heating rotor 9*a* and the pressing rotor 9*b* presses the paper T that has been subjected to the secondary transfer of the toner image by sandwiching them and conveys the paper T as well. By conveying the paper T in a state in which the paper T is sandwiched between the heating rotor 9*a* and the pressing rotor 9*b*, the toner transferred onto the paper T is fixed onto the paper T by being melted and pressed.

Next, the paper feed and discharge unit KH will be described.

As shown in FIG. 1, a paper feeding cassette 52 which houses the paper T is arranged at the lower part of the device body M. The paper feeding cassette 52 is configured to be capable to be drawn outwards from the case body BD of the device body M. A placing board 60 where the paper T is placed on is arranged in the paper feeding cassette 52. The paper T is housed in the paper feeding cassette 52 in a state where it is stacked on the placing board 60. The paper T that is placed on the placing board 60 is sent out to the carrier path L by the cassette paper feeding unit 51 arranged at an end (an end at the right side in FIG. 1) on the paper sending side of the paper feeding cassette 52. The cassette paper feeding unit 51 includes an overlapping carry prevention mechanism which comprises a forward carrying roller 61 for taking out the paper T on the placing board 60, and a feeding roller pair 81 for sending out the paper T one sheet at a time to the carrier path L.

A manual feeding unit 64 is provided on the right side (the right side in FIG. 1) of the device body M. The manual feeding unit 64 is provided mainly for the purposes of supplying to the device body M paper T of a different size or kind from the paper T that is set in the paper feeding cassette 52. The manual feeding unit 64 includes a manual feed tray 65 which configures a part of the right side of the device body M in a closed state, and feed roller 66. As to the manual feed tray 65, its lower end is attached freely rotatable (free to be opened and closed) in proximity to the paper feeding roller 66. The paper T is placed on the manual feed tray 65 that is in an open form. The feed roller 66 feeds the paper T placed on the manual feed tray 65 that is in the open form to the manual carrier path La.

The carrier path L which conveys the paper T includes: a first carrier path L1 extending from the cassette paper feeding unit 51 to the secondary transfer nip N2; a second carrier path L2 extending from the secondary transfer nip N2 to the fixing unit 9; a third carrier path L3 extending from the fixing unit 9 to the paper discharge unit 50; a manual carrier path La which makes the paper supplied from the manual feeding unit 64 come into the first carrier path L1; and a return carrier path Lb which sends back the paper that has been conveyed in the third carrier path L3 from the downstream to the upstream to the first carrier path L1 with the sides of the paper reversed.

In addition, the first merging portion P1 and the second merging portion P2 are formed in the stream of the first carrier path L1. The first branching portion Q1 is provided in the stream of the third carrier path L3.

The first merging portion P1 is a merging portion where the manual carrier path La merges with the first carrier path L1. The second merging portion P2 is a merging portion where the return carrier path Lb merges with the first carrier path L1.

The first branching portion Q1 is a branching portion where the return carrier path Lb branches from the third carrier path L3.

In the stream of the first carrier path L1 (between the second merging portion P2 and the secondary transfer nips N2, in detail), there are arranged a paper detection sensor (not illustrated) for detecting the paper T, and a resist roller pair 80 for adjusting the timing with the correction of skew (slanted feeding) of the paper T, the formation of the toner image in the image forming unit GK, and the like. The above-described paper detection sensor is arranged just before the resist roller pair 80 in the conveying direction of the paper T (upstream in the conveying direction). The resist roller pair 80 conveys the paper T by performing the above-described correction or timing adjustment based on the detection signal information from the paper detection sensor.

An intermediate roller pair 82 is arranged between the first merging portion P1 and the second merging portion P2 in the first carrier path L1. The intermediate roller pair 82 is arranged at the downstream of the paper conveying direction to the feeding roller pair 81 and sandwiches the paper T that has been conveyed from the feeding roller pair 81 to convey it to the resist roller pair 80.

The return carrier path Lb is a carrier path provided for causing the opposite side surface (non-printed surface) from the surface that has been already printed to face the intermediate transfer belt 7 upon performing double sided printing onto the paper T. According to the return carrier path Lb, it is possible to send the paper T that has been conveyed from the first branching portion Q1 to the paper discharge unit 50 side back to the first carrier path L1, and to convey it to the upstream of the resist roller pair 80 arranged at the upstream of the secondary transfer roller 8. On the paper T, the sides of which have been reversed by the return carrier path Lb, the toner image is transferred to the non-printed surface in the secondary transfer nip N2.

A branch member 58 is provided at the first branching portion Q1. The branch member 58 guides the conveying direction of the paper T that is to be taken out from the fixing unit 9 and conveyed in the third carrier path L3 from the upstream to the downstream to the conveying direction directed toward the paper discharge unit 50, and guides the conveying direction of the paper T that is to be conveyed from the paper discharge unit 50 in the direction from the downstream to the upstream in the third carrier path L3 to the conveying direction directed toward the return carrier path Lb.

A paper discharge unit 50 is formed at the end of the third carrier path L3. The paper discharge unit 50 is arranged in the upper part of the device body M. The paper discharge unit 50 is open toward the left surface side (left side in FIG. 1) of the device body M. The paper discharge unit 50 discharges the paper T to the exterior of the device body M. The paper discharge unit 50 has a discharge roller pair 53. By the discharge roller pair 53, the paper T that has been conveyed from the upstream to the downstream in the third carrier path L3 is discharged to the exterior of the device body M. In addition, it is possible to convey the paper T toward the upstream of the third carrier path L3 by causing the paper T to be reversed at the paper discharge unit 50.

The discharged paper accumulation portion M1 is formed at the side of the opening of the paper discharge unit 50. The discharged paper accumulation portion M1 is formed at the top surface (outside surface) of the device body M. The discharged paper accumulation portion M1 is the portion where the top surface of the device body M is formed depressed. The bottom of the discharged paper accumulation portion M1 configures a part of the top surface of the device body M. At the discharged paper accumulation portion M1, the paper T on which a predetermined toner image has been formed and discharged from the paper discharge unit 50 is stacked and accumulated.

It should be noted that a sensor for paper detection (not illustrated) is arranged in a predetermined position in each carrier path.

Next, the operation of the printer 1 according to the first embodiment will be described briefly with reference to FIG. 1.

First, the case where single side printing is performed onto the paper T that is housed in the paper feeding cassette 52 will be described.

The paper T housed in the paper feeding cassette 52 is sent out to the first carrier path L1 by the forward feeding roller 61 and the feeding roller pair 81, and then, is conveyed to the resist roller pair 80 by the intermediate roller pair 82 via the first merging portion P1 and the first carrier path L1.

At the resist roller pair 80, the skew correction of the paper T and the timing adjustment with the formation of the toner image in the image forming unit GK are performed.

The paper T discharged from the resist roller pair 80 is introduced at between the intermediate transfer belt 7 and the secondary transfer roller 8 (the secondary transfer nip N2) via the first carrier path L1. Then, the toner image is transferred onto the paper T at between the intermediate transfer belt 7 and the secondary transfer roller 8.

Thereafter, the paper T is discharged from between the intermediate transfer belt 7 and the secondary transfer rollers 8, and is introduced into the fixation nip at between the heating rotor 9*a* and the pressing rotor 9*b* in the fixing unit 9 via the second carrier path L2. Then, the toner melts in the fixation nip and the toner is fixed onto the paper T.

Subsequently, the paper T is conveyed to the paper discharge unit 50 via the third carrier path L3, and is discharged from the paper discharge unit 50 to the discharged paper accumulation portion M1 by the discharge roller pair 53.

Thus, the single side printing onto the paper T that was housed in the paper feeding cassette 52 is completed.

When performing the single side printing onto the paper T placed on the manual feed tray 65, the paper T placed on the manual feed tray 65 is sent out to the manual carrier path La by the paper feeding roller 66, and then, is conveyed to the resist roller pair 80 via the first merging portion P1 and the first carrier path L1. The operation thereafter is the same as the above-described operation of the single side printing onto the paper T housed in the paper feeding cassette 52 and the description is omitted.

Next, the operation of the printer 1 when performing the double side printing will be described.

As described above, in the case of the single side printing, the paper T that has been subjected to the single side printing is discharged from the paper discharge unit 50 to the discharged paper accumulation portion M1 and the printing operation is completed.

On the other hand, when performing the double side printing, the side of the paper T that has been subjected to the single side printing is reversed from the time of the single side printing and is again conveyed to the resist roller pair 80 via the return carrier path Lb, and thus the double side printing is performed onto the paper T.

In detailed explanation, the operation until the paper T that has been subjected to the single side printing is discharged from the paper discharge unit 50 by the discharge roller pair 53 is the same as that of the single side printing described above. In the case of double side printing, in a state where the paper T that has been subjected to the single side printing is held by the discharge roller pair 53, the rotation of the discharge roller pair 53 is stopped and is rotated in a reverse direction. Thus, when the discharge roller pair 53 is rotated in a reverse direction, the paper T that is held by the discharge roller pair 53 is conveyed onto the third carrier path L3 in a reverse direction (the direction from the paper discharge unit 50 toward the first branching portion Q1).

As described above, the paper T is conveyed on the third carrier path L3 in the reverse direction. Then, the flow of the paper T is adjusted to the return carrier path Lb by the branch member 58 and thereafter the paper T joins the first carrier path L1 via the second merging portion P2. Here, the sides of the paper T are reversed from the time of the single side printing.

Furthermore, the paper T is subjected to the above-described correction or the adjustment by the resist roller pair 80, and is introduced into the secondary transfer nip N2 via the first carrier path L1. Since the non-printed surface of the paper T faces the intermediate transfer belt 7 by routing the return carrier path Lb, the toner image is transferred to the non-printed surface and thus the double side printing is performed onto the paper T.

The shaft member holding mechanism and the photoconductor drum unit including the shaft member holding mechanism will be described with reference to FIG. 2 to FIG. 6. Hereafter, the shaft member holding mechanism 110*a* corresponding to the photoconductor drum 2*a* will be described mainly, and the description of the shaft member holding mechanisms 110*b*, 110*c* and 110*d* corresponding to the photoconductor drums 2*b*, 2*c* and 2*d* that have similar structure will be omitted. Here, the structure of the shaft member holding mechanisms 110*b*, 110*c* and 110*d* is similar to that of the shaft member holding mechanism 110*a*, and the description of the shaft member holding mechanism 110*a* is incorporated for the description thereof.

Figure 3:
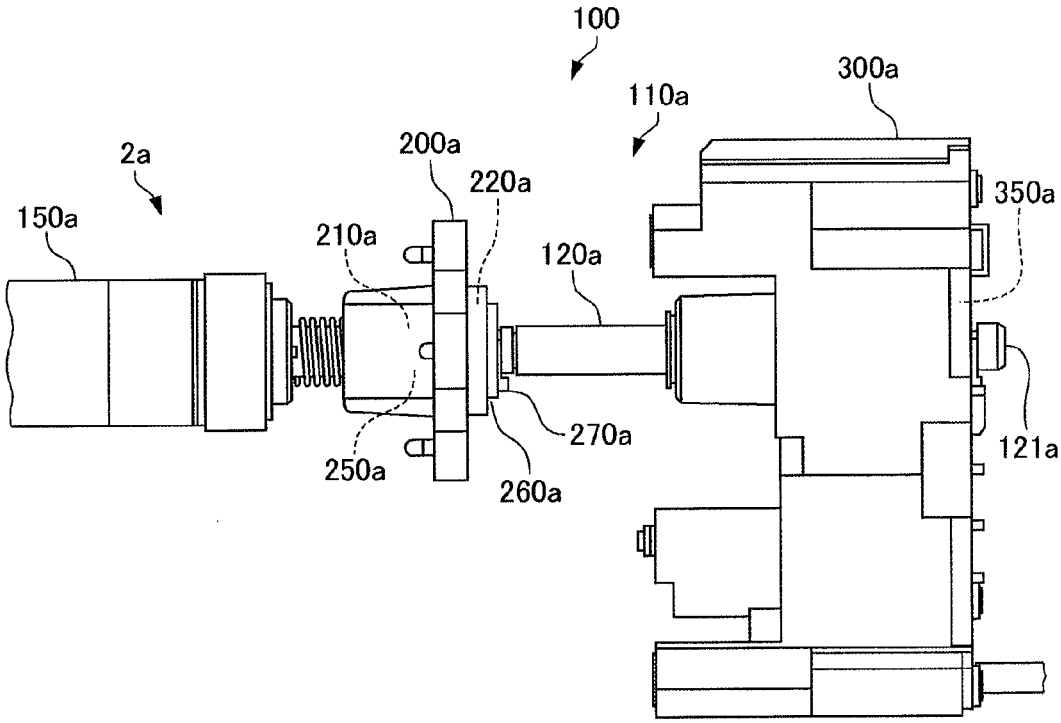
FIG. 3 is an enlarged view of a region A in FIG. 2.
Figure 4:
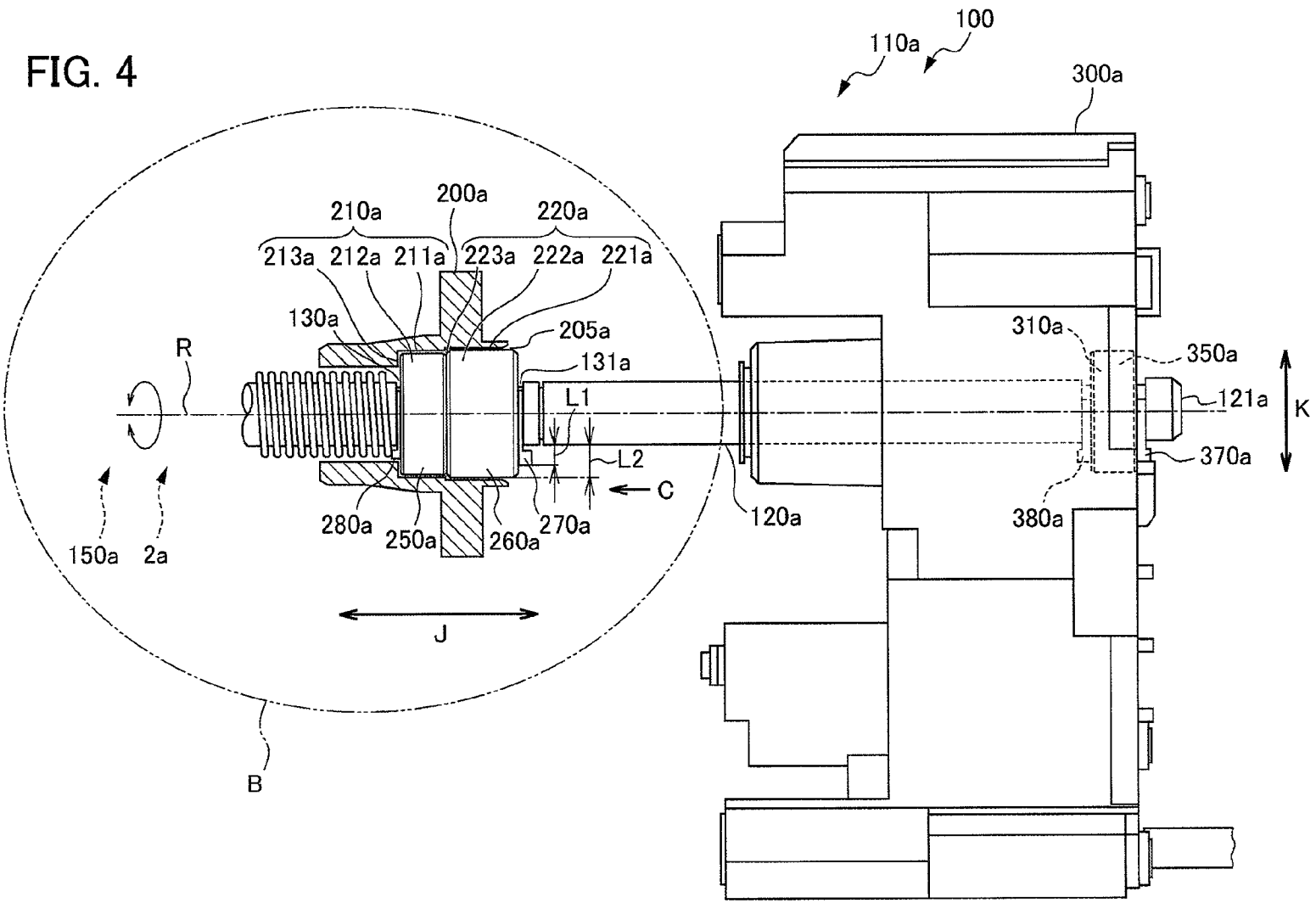
FIG. 4 is a partial cross sectional view for illustrating a shaft member holding mechanism.
Figure 5:
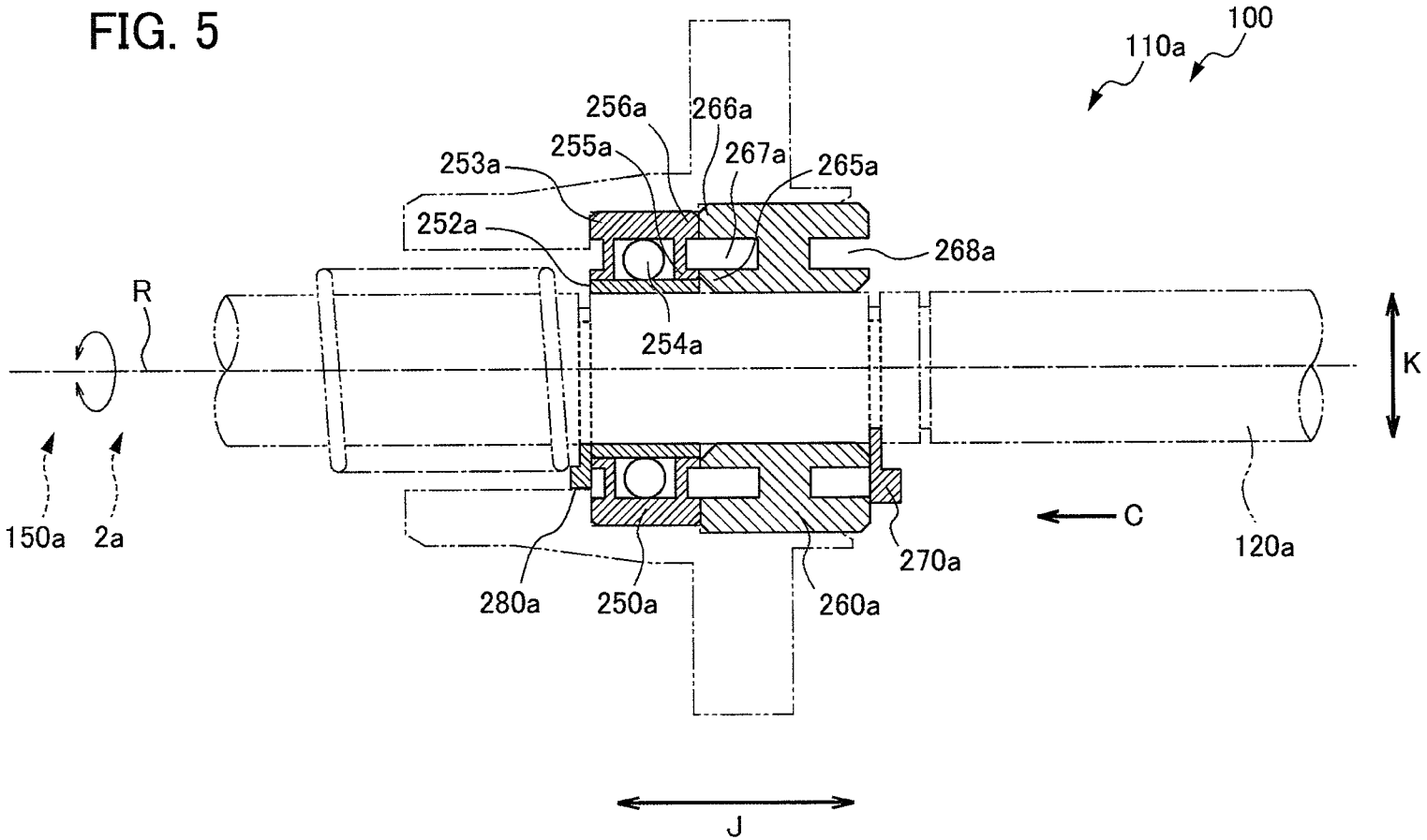
FIG. 5 is an enlarged view of a region B in FIG. 4 and is a cross sectional view for illustrating the shaft member holding mechanism.
Figure 6:
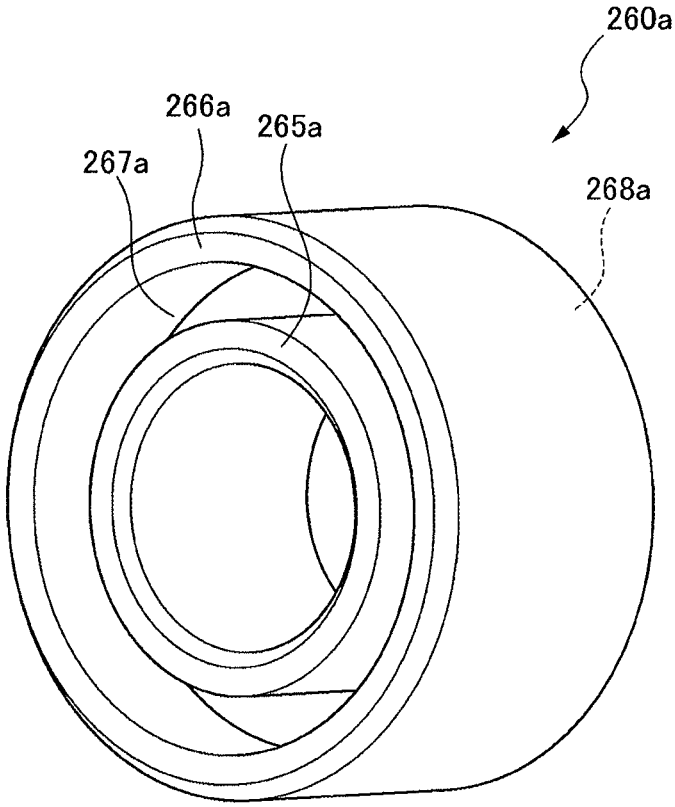
FIG. 6 is a perspective view for illustrating an inclination suppression member.

FIG. 2 is a drawing illustrating a state where the photoconductor drum is held rotatably by the first holding member and the second holding member. FIG. 3 is an enlarged view of the region A in FIG. 2. FIG. 4 is a partial cross sectional view for illustrating the shaft member holding mechanism. FIG. 5 is an enlarged view of the region B in FIG. 4, and is a cross sectional view for illustrating the shaft member holding mechanism. FIG. 6 is a perspective view for illustrating the inclination suppression member.

First, the photoconductor drum unit 100 will be described.

As shown in FIG. 2, the photoconductor drum unit 100 includes: the shaft member holding mechanism 110*a*; the photoconductor drum 2*a* including the first shaft member 120*a* held rotatably in the shaft member holding mechanism 110*a*; and the photoconductor drum drive unit 500 that is not illustrated and is joined to the second shaft member 140*a* in the photoconductor drum 2*a*.

As described above, the photoconductor drum 2*a* includes: the photoconductor drum body 150*a*; the first shaft member 120*a* arranged on one end side of the photoconductor drum body 150*a* in the rotation axis direction J; and the second shaft member 140*a* arranged at the other end side. Here, the photoconductor drum body 150*a* is arranged at the opposite side of the first bearing 250*a* described later from the inclination suppression member 260*a* side in the first shaft member 120*a*.

The photoconductor drum unit 100 is configured so that the photoconductor drum 2*a* can rotate about the rotation axis R (refer to FIG. 4).

The photoconductor drum unit 100 holds rotatably the first shaft member 120*a* arranged at one end side of the photoconductor drum 2*a*. Specifically, the shaft member holding mechanism 110*a* included in the photoconductor drum unit 100 holds the first shaft member 120*a* rotatably about the rotation axis R (refer to FIG. 4).

The photoconductor drum unit 100 rotationally drives the second shaft member 140*a* arranged at the other end side of the photoconductor drum 2*a*. Specifically, the photoconductor drum drive unit 500 included in the photoconductor drum unit 100 transmits the rotational driving force to the second shaft member 140*a*.

Thereby, the photoconductor drum 2*a* (photoconductor drum body 150*a*) held rotatably at the first shaft member 120*a* is rotated about the rotation axis R by the rotational driving force transmitted to the second shaft member 140*a*.

Here, the photoconductor drum drive unit 500 includes: a rotational drive unit (for example, motor) which generates rotational driving force by the electric power supplied from the power source and can output the generated rotational driving force; a transmission unit (for example, various gears) which transmits the rotational driving force outputted from the rotational drive unit; and a joint portion (for example, a joint) which is joined to the second shaft member 140*a* and makes the rotational driving force transmitted by the transmission unit to be transmitted to the second shaft member 140*a*.

Next, the shaft member holding mechanism 110*a* will be described.

As shown in FIG. 3 and FIG. 4, the shaft member holding mechanism 110*a* includes: the first shaft member 120*a*; the first bearing 250*a*; the first holding member 200*a* having the first holding portion 210*a* that holds the first bearing 250*a*; and the inclination suppression member 260*a* arranged at the end 121*a* side of the first shaft member 120*a* in the first bearing 250*a*.

In addition, in the present embodiment, the shaft member holding mechanism 110*a* includes: the first clip 270*a* (first regulation member) arranged to contact with the inclination suppression member 260*a*; and the second clip 280*a* (second regulation member) arranged to contact with the first bearing 250*a*.

In addition, in the present embodiment, the shaft member holding mechanism 110*a* includes: the second bearing 350*a* arranged at the end side of the first shaft member 120*a*; the second holding member 300*a* that has the second holding portion 310*a* that holds the second bearing 350*a*; and the third clip 370*a* and the fourth clip 380*a* which are arranged to sandwich the second bearing 350*a*.

As shown in FIG. 4, the first shaft member 120*a* is arranged at one end side of the photoconductor drum 2*a*. The first shaft member 120*a* is held rotatably about the rotation axis R by the first bearing 250*a* and the second bearing 350*a*.

As shown in FIG. 4 and FIG. 5, the first bearing 250*a* is attached to the position spaced apart by a predetermined distance from the second bearing 350*a* that is arranged at one end side of the first shaft member 120*a* which is in proximity to the end 121*a* of the first shaft member 120*a* to the inside of the device body in the rotation axis direction J.

The first bearing 250*a* holds the first shaft member 120*a* rotatably together with the second bearing 350*a*.

As shown in FIG. 5, the first bearing 250*a* includes: an outer ring portion 253*a* arranged at the outside of the diameter direction K of the first shaft member 120*a*; an inner ring portion 252*a* arranged at the inside of the diameter direction K; and a plurality of ball members 254*a* arranged between the inner ring portion 252*a* and the outer ring portion 253*a* on the diameter direction K.

The inner ring portion 252*a* holds the first shaft member 120*a* so that the first shaft member 120*a* fits into the inner ring portion 252*a*. The inner ring portion 252*a* is arranged at the inside of the diameter direction K of the outer ring portion 253*a* so that it can rotate relatively to the outer ring portion 253*a*.

The inner ring portion 252*a* does not contact with the inclination suppression member 260*a* described later.

The outer ring portion 253*a* is arranged at the outside of the diameter direction K of the inner ring portion 252*a* so as to rotate relatively to the inner ring portion 252*a*. The outer ring portion 253*a* holds the ball members 254*a* so that the ball members 254*a* are rotatable.

The outer ring portion 253*a* is held onto the first holding portion 210*a* (refer to FIG. 4) described later so that the rotation of the outer ring portion 253*a* is regulated. In a state in which the outer ring portion 253*a* is held by the first holding portion 210*a*, the outer ring portion 253*a* holds the inner ring portion 252*a* via the ball members 254*a* so that the inner ring portion 252*a* can rotate relatively to the outer ring portion 253*a*.

The outer ring portion 253*a* has a first contacted portion 255*a* and a second contacted portion 256*a* which are formed on the side of the inclination suppression member 260*a* described later. The first contacted portion 255*a* and the second contacted portion 256*a* are formed to project towards the inclination suppression member 260*a*. Each of the first contacted portion 255*a* and the second contacted portion 256*a* is formed as a ring shape when viewed from the rotation axis direction J.

The first contacted portion 255*a* is a portion to be contacted with the first contacting portion 265*a* and is located at the inside of the diameter direction K and is described later. The second contacted portion 256*a* is a portion to be contacted with the second contacting portion 266*a* that is located at the inside of the diameter direction K and is described later.

The outer ring portion 253*a* is to be contacted with the inclination suppression member 260*a* described later.

As shown in FIG. 4, the first bearing 250*a* is inserted and held in the first holding portion 210*a* formed in the first holding member 200*a* described later.

Specifically, the first bearing 250*a* is inserted into the first insertion space 212*a* that configures the first holding portion 210*a*, setting the opposite side (the photoconductor drum body 150*a* side) from the side of an inclination suppression member 260*a* described later to the front side of the first bearing 250*a*. Here, since the first insertion space 212*a* is positioned spaced apart from the opening 205*a* described later at the back side in the insertion direction C, the first bearing 250*a* may incline from the posture (the desired posture and angle) initially set from the rotation axis R when moved during the insertion.

The first bearing 250*a* is suppressed from inclining by the inclination suppression member 260*a* from the posture at the time of installation during movement in a state where the first bearing 250*a* has been installed to the first shaft member 120*a* in order to be inserted (fit) into the first insertion space 212*a*.

Thereby, the first bearing 250*a* is held to the first holding portion 210*a* in a state having a configuration in which the diameter of the first bearing 250*a* intersects orthogonally to the rotation axis R and is maintained while being moved as described above.

The first bearing 250*a* inserted (fitted) in the first insertion space 212*a* is held in a state where the rotation in the outer ring portion 253*a* is regulated by the first holding surface 211*a* that configures the first holding portion 210*a*.

In addition, the first bearing 250*a* is held by the first holding portion 210*a* in a state where movement to the side of the photoconductor drum body 150*a* in the rotation axis direction J is regulated by the first wall portion 213*a*.

As shown in FIG. 4, the first holding member 200*a* is arranged spaced apart from the second holding member 300*a* by a predetermined distance to the photoconductor drum body 150*a* side in the rotation axis direction J. Here, for example, the predetermined distance is greater than or equal to 10 mm, preferably greater than or equal to 20 mm.

The first holding member 200*a* includes the first holding portion 210*a* (bearing holding portion) which holds the outer ring portion 253*a* in the first bearing 250*a* in a state where the rotation of the outer ring portion 253*a* is regulated. In addition, the first holding member 200*a* includes the inclination suppression member holding portion 220*a* that houses and holds the inclination suppression member 260*a*.

The first holding portion 210*a* is formed in the first holding member 200*a*. The first holding portion 210*a* is arranged spaced apart by a predetermined distance from the second holding portion 310*a* formed in the second holding member 300*a* in the rotation axis direction J.

The first holding portion 210*a* has the first holding surface 211*a*, the first insertion space 212*a*, and the first wall portion 213*a*.

The first holding surface 211*a* is a curved surface that configures an outline of the first insertion space 212*a*, and is formed corresponding to the peripheral surface of the first bearing 250*a*. The first holding surface 211*a* contacts the peripheral surface of the first bearing 250*a*, and regulates the rotation of the outer ring portion 253*a* in the first bearing 250*a* and holds the first bearing 250*a* as well.

The first insertion space 212*a* is formed continuously to the inclination suppression member insertion space 222*a* described later. The first insertion space 212*a* is formed at the back side of the inclination suppression member insertion space 222*a* formed in the opening 205*a* side in the insertion direction C and is formed continuously to the inclination suppression member insertion space 222*a* as well.

The first insertion space 212*a* is a space formed in a hollow shape. The first insertion space 212*a* is a cylindrical hollow portion. The first insertion space 212*a* is a space formed by the first holding surface 211*a*.

The first bearing 250*a* is inserted into the first insertion space 212*a*. Specifically, the first bearing 250*a* moved by passing through the inclination suppression member insertion space 222*a* which also serves as the passage space described later is inserted into the first insertion space 212*a*.

The first wall portion 213*a* is a portion formed continuously to the peripheral edge of the first holding surface 211*a* at the back side in the insertion direction C and to extend from the first holding surface 211*a* to the rotation axis R.

The first wall portion 213*a* regulates the movement of the first bearing 250*a* toward the insertion direction C.

The inclination suppression member holding portion 220*a* is formed at the front side of the first holding portion 210*a* in the insertion direction C (the right side and the opening 205*a* side in FIG. 4).

The inclination suppression member holding portion 220*a* includes the inclination suppression member holding surface 221*a*, the inclination suppression member holding portion 220*a*, and the second wall portion 223*a*. Here, the opening 205*a* is formed at the front side of the inclination suppression member holding portion 220*a* in the insertion direction C.

The inclination suppression member holding surface 221*a* is a curved surface that configures an outline of the inclination suppression member insertion space 222*a*, and is formed corresponding to the peripheral surface of the inclination suppression member 260*a* described later. The inclination suppression member holding surface 221*a* holds the inclination suppression member 260*a* by contacting to and fitting into the peripheral surface of the inclination suppression member 260*a*.

The inclination suppression member insertion space 222*a* is formed continuously to the first insertion space 212*a* described later at the front side in the insertion direction C. The inclination suppression member insertion space 222*a* is formed between the opening 205*a* and the first insertion space 212*a* so as to connect the opening 205*a* and the first insertion space 212*a*.

The inclination suppression member insertion space 222*a* is formed in a hollow shape. The inclination suppression member insertion space 222*a* is a cylindrical hollow portion. The inclination suppression member insertion space 222*a* is a space formed by the inclination suppression member holding surface 221*a*.

The opening 205*a* is formed at the front side of the inclination suppression member insertion space 222*a* in the insertion direction C. The first bearing 250*a* which is moved toward the insertion direction C via the opening 205*a* passes through the inclination suppression member insertion space 222*a*. The inclination suppression member insertion space 222*a* functions as a passage space where the first bearing 250*a* passes through.

The inclination suppression member 260*a* that is moved together with the first bearing 250*a* is inserted (fitted) into the inclination suppression member insertion space 222*a*.

The second wall portion 223*a* is a portion formed continuously to the peripheral edge of the inclination suppression member holding surface 221*a* at the back side in the insertion direction C and to extend from the inclination suppression member holding surface 221*a* to the direction of the rotation axis R. The second wall portion 223*a* is formed so as to connect the inclination suppression member holding surface 221*a* and the first holding surface 211*a*. The second wall portion 223*a* regulates the movement of the inclination suppression member 260*a* toward the insertion direction C.

Here, in the present embodiment, as shown in FIG. 4, the inner diameter of the opening 205*a* is greater than or equal to the outside diameters of the first bearing 250*a* and the inclination suppression member 260*a*.

In addition, the inner diameter of the inclination suppression member insertion space 222*a* is greater than or equal to the inner diameter of the first insertion space 212*a* and smaller than or equal to the inner diameter of the opening 205*a*.

As shown in FIG. 4 and FIG. 5, the inclination suppression member 260*a* is arranged to contact with the first bearing 250*a* at one side of the first bearing 250*a* in the rotation axis direction J. The inclination suppression member 260*a* is arranged at the end 121*a* side of the first bearing 250*a* in the rotation axis direction J.

As shown in FIG. 5 and FIG. 6, the inclination suppression member 260*a* has the first contacting portion 265*a* and the second contacting portion 266*a* which are formed at the first bearing 250*a* side.

The first contacting portion 265*a* and the second contacting portion 266*a* are formed to project towards the first bearing 250*a* side. The first contacting portion 265*a* and the second contacting portion 266*a* are respectively formed in a ring shape when viewed from the rotation axis direction J. The first contacting portion 265*a* and the second contacting portion 266*a* are formed at positions and in shapes that correspond to the first contacted portion 255*a* and the second contacted portion 256*a*, respectively.

The first contacting portion 265*a* and the second contacting portion 266*a* are arranged to contact with the first contacted portion 255*a* and the second contacted portion 256*a*, respectively.

Only the first contacting portion 265*a* and the second contacting portion 266*a* in the inclination suppression member 260*a* are arranged to contact with the first bearing 250*a*. That is, the inclination suppression member 260*a* is arranged to contact to the first bearing 250*a* with only the outer ring portion 253*a*. The inclination suppression member 260*a* contacts with the outer ring portion 253*a* and does not contact with the inner ring portion 252*a*.

The inclination suppression member 260*a* suppresses the inclination of the first bearing 250*a*. In addition, the inclination suppression member 260*a* suppresses the inclination of the first bearing 250*a* when the first bearing 250*a* is inserted into the first insertion space 212*a*.

The inclination suppression member 260*a* is formed so that the maximum inclination in a state where the first shaft member 120*a* is solely installed is smaller than the maximum inclination in a state where the first bearing 250*a* is solely installed to the first shaft member 120*a*. That is, preferably, the inclination suppression member 260*a* is hard to incline than the first bearing 250*a* which is an object to suppress inclination. Here, the inclination can be measured by a projection planar image of the inclination suppression member 260*a* and the first bearing 250*a* that are projected to a flat surface including the rotation axis R and the diameter of the inclination suppression member 260*a* (the first bearing 250*a*).

In addition, the inclination suppression member 260*a* is configured so that its length in the rotation axis direction J is greater than the length of the first bearing 250*a* in the rotation axis direction J.

Here, when the inner diameter of the inclination suppression member 260*a* and the inner diameter of the first bearing 250*a* are substantially the same, the greater the length of the inclination suppression member 260*a* in the rotation axis direction J is, the smaller the above-described maximum inclination becomes. For this reason, the greater the length of the inclination suppression member 260*a* in the rotation axis direction J is, the more preferable it is.

The inclination suppression member 260*a* is housed in and held by the inclination suppression member holding portion 220*a* in the first holding member 200*a*.

The inclination suppression member 260*a* is arranged to be inserted into the inclination suppression member insertion space 222*a* in the inclination suppression member holding portion 220*a*. The inclination suppression member 260*a* fits onto the inclination suppression member holding surface 221*a* of the inclination suppression member holding portion 220*a*.

The inclination suppression member 260*a* suppresses the inclination of the first bearing 250*a* that is arranged to be inserted into the first insertion space 212*a*.

In addition, the inclination suppression member 260*a* suppresses the inclination of the first bearing 250*a* in a state where the first bearing 250*a* is inserted and moved. In detail, the inclination suppression member 260*a* suppresses the inclination of the first bearing 250*a*, from the posture at the time of initial installation during the move (motion), when inserted into the first insertion space 212*a* by passing through the inclination suppression member insertion space 222*a*.

Here, the inclination suppression member 260*a* has a first concave portion 267*a* and a second concave portion 268*a* which are formed on both sides of the inclination suppression member 260*a* in the rotation axis direction J. The first concave portion 267*a* and the second concave portion 268*a* are respectively concave portions that are formed in ring shapes continuously in the circumferential direction. Here, the second concave portion 268*a* can also be used when inserting the first bearing 250*a* and the inclination suppression member 260*a* into the first holding portion 210*a*. For example, when using a predetermined attaching tool having an insertion portion having a shape (for example, a cylindrical shape) that can be inserted into the second concave portion 268*a*, the user can perform the insertion operation by pushing the insertion portion in the insertion direction C in a state where the insertion portion has been inserted into the second concave portion 268*a*.

Preferably, the inclination suppression member 260*a* is constituted by a hard material (quality of material). Examples of the material for the inclination suppression member 260*a* include resin (ABS (acrylonitrile butadiene styrene) and the like), metal, and the like, for example.

As shown in FIG. 4 and FIG. 5, the first clip 270*a* (the first regulation member) is arranged at the opposite side of the inclination suppression member 260*a* from the first bearing 250*a* side.

The first clip 270*a* is attached to the first shaft member 120*a* at the end 121*a* side of the inclination suppression member 260*a* and is arranged to contact with the inclination suppression member 260*a*.

The first clip 270*a* is formed substantially in a C shape, which has an open portion at one side. The first clip 270*a* is arranged so that it fits into the first groove portion 131*a* formed at the end 121*a* side of the inclination suppression member 260*a* in the first shaft member 120*a* to extend in the circumferential direction.

The first clip 270*a* arranged to fit into the first groove portion 131*a* regulates the movement of the inclination suppression member 260*a* to the end 121*a* side in the rotation axis direction J and regulates the inclination of the inclination suppression member 260*a*.

The first clip 270*a* is formed so that its projection length TL1 which is the length projecting from the surface of the first shaft member 120*a* in the diameter direction K which intersects orthogonally to the rotation axis direction J has a ratio to the projection length TL2 of the inclination suppression member 260*a* greater than or equal to 0.5, and preferably, greater than or equal to 0.6, and more preferably, greater than or equal to 1.0.

The second clip 280*a* is arranged at the opposite side of the first bearing 250*a* from the inclination suppression member 260*a* side. The second clip 280*a* is attached to the first shaft member 120*a* at the photoconductor drum body 150*a* side of the first bearing 250*a* and is arranged to contact with the first bearing 250*a*.

As in the first clip 270*a*, the second clip 280*a* (the second regulation member) is substantially formed in C shape that is opened at one side. The second clip 280*a* is arranged to fit into the second groove portion 130*a* which is formed to extend in the circumferential direction of the first bearing 250*a* in the first shaft member 120*a* at the photoconductor drum body 150*a* side. The second clip 280*a* arranged to fit into the second groove portion 130*a* regulates the movement of the first bearing 250*a* towards the photoconductor drum body 150*a* side in the rotation axis direction J and the inclination of the first bearing 250*a*.

As shown in FIG. 4, the second bearing 350*a* is arranged at the end 121*a* side of the first shaft member 120*a*. The second bearing 350*a* supports (maintains) the first shaft member

120*a* rotatably together with the first bearing 250*a*. The second bearing 350*a* is configured similar to the first bearing 250*a*.

The second holding member 300*a* is arranged in proximity to the end 121*a* of the first shaft member 120*a*.

The second holding portion 310*a* that holds the second bearing 350*a* is formed in the second holding member 300*a*.

The second bearing 350*a* is inserted into and is held by the second holding portion 310*a* formed in the second holding member 300*a* described later.

The second holding member 300*a* holds the outer ring portion of the second bearing 350*a* in a state where the rotation of the outer ring portion is regulated. The second holding portion 310*a* is configured similar to the first holding portion 210*a*.

The movement of the second bearing 350*a* in the rotation axis direction J is regulated by the third clip 370*a* and the fourth clip 380*a* which are arranged to sandwich the second bearing 350*a* in the rotation axis direction J. The third clip 370*a* and the fourth clip 380*a* are configured similar to the second clip 280*a*.

Next, the procedure of attaching the first bearing 250*a* in a state where the first shaft member 120*a* is installed to the first holding portion 210*a* will be described with reference to FIG. 7A to FIG. 7C.

Figure 7A:
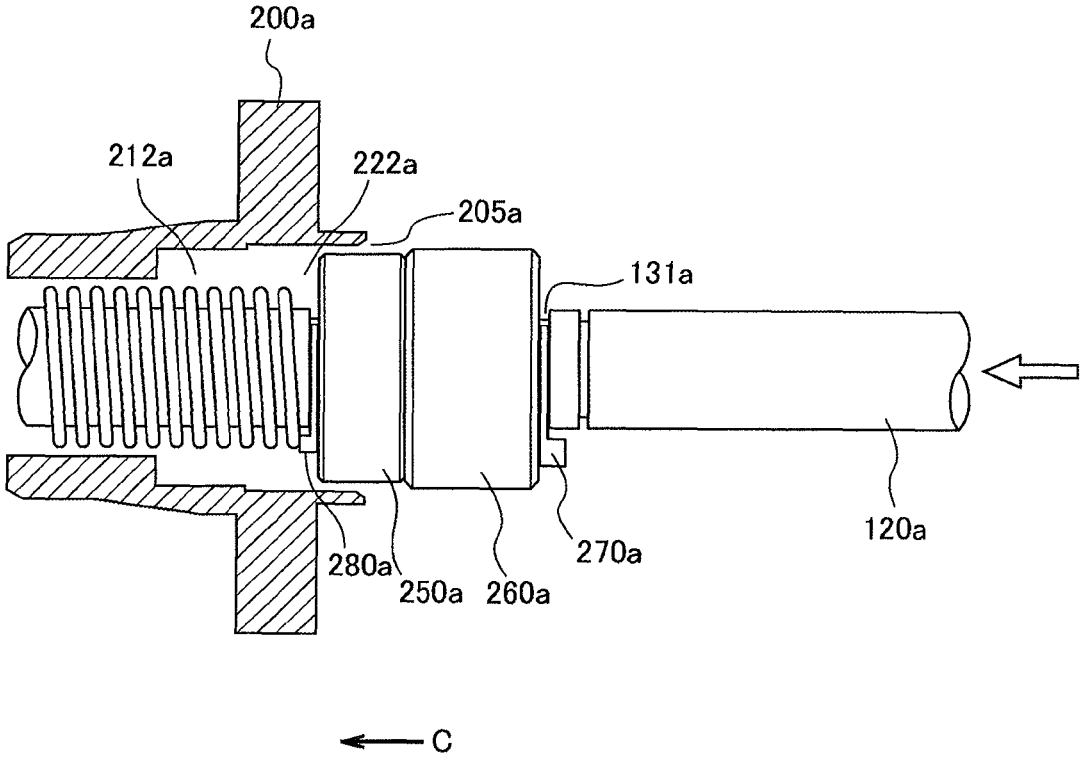
FIG. 7A is a drawing illustrating an initial state in a procedure of attaching to a first holding portion a first bearing in a state where it has been installed to a first shaft member.

FIG. 7A is a drawing illustrating an initial state in the procedure of attaching to the first holding portion 210*a* the first bearing 250*a* where the first shaft member 120*a* has been installed. FIG. 7B is a drawing illustrating an inserting state in the procedure of attaching to the first holding portion 210*a* the first bearing 250*a* where the first shaft member 120*a* has been installed. FIG. 7C is a drawing illustrating an attached state in the procedure of attaching to the first holding portion 210*a* the first bearing 250*a* where it has been installed to the first shaft member 120*a*.

First, as shown in FIG. 7A, a worker installs the first bearing 250*a* and the inclination suppression member 260*a* to the first shaft member 120*a*. The worker installs the first bearing 250*a* by adjusting it to a desired angle. The worker attaches to the first shaft member 120*a* the first clip 270*a* that suppresses the movement and the inclination of the inclination suppression member 260*a*, and the second clip 280*a* that regulates the movement of the first bearing 250*a*.

Figure 7B:
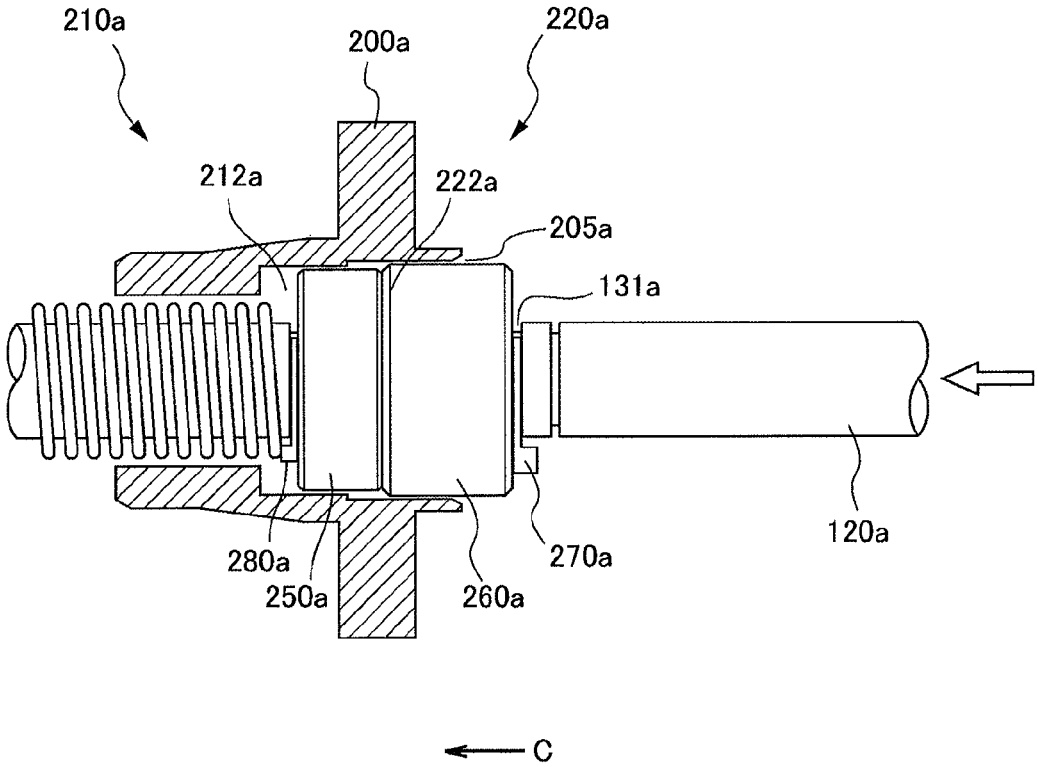
FIG. 7B is a drawing illustrating an inserting state in the procedure of attaching to the first holding portion the first bearing in a state where it has been installed to the first shaft member.

Subsequently, as shown in FIG. 7B, the worker moves the first bearing 250*a* and the inclination suppression member 260*a* toward the insertion direction C with the first bearing 250*a* at the front side.

Here, the worker may move the first bearing 250*a* and the inclination suppression member 260*a* toward the insertion direction C by using the attachment tool described above and pushing out the inclination suppression member 260*a* toward the insertion direction C.

In this insertion move, the first bearing 250*a* is inserted into the inclination suppression member insertion space 222*a* from the opening 205*a* and is inserted into the first insertion space 212*a* by passing through the inclination suppression member insertion space 222*a*. In addition, following the first bearing 250*a*, the inclination suppression member 260*a* is inserted into the inclination suppression member insertion space 222*a* from the opening 205*a*.

Here, the inclination suppression member 260*a* contacts with the first bearing 250*a* and suppresses the inclination of the first bearing 250*a* during the insertion move.

Figure 7C:
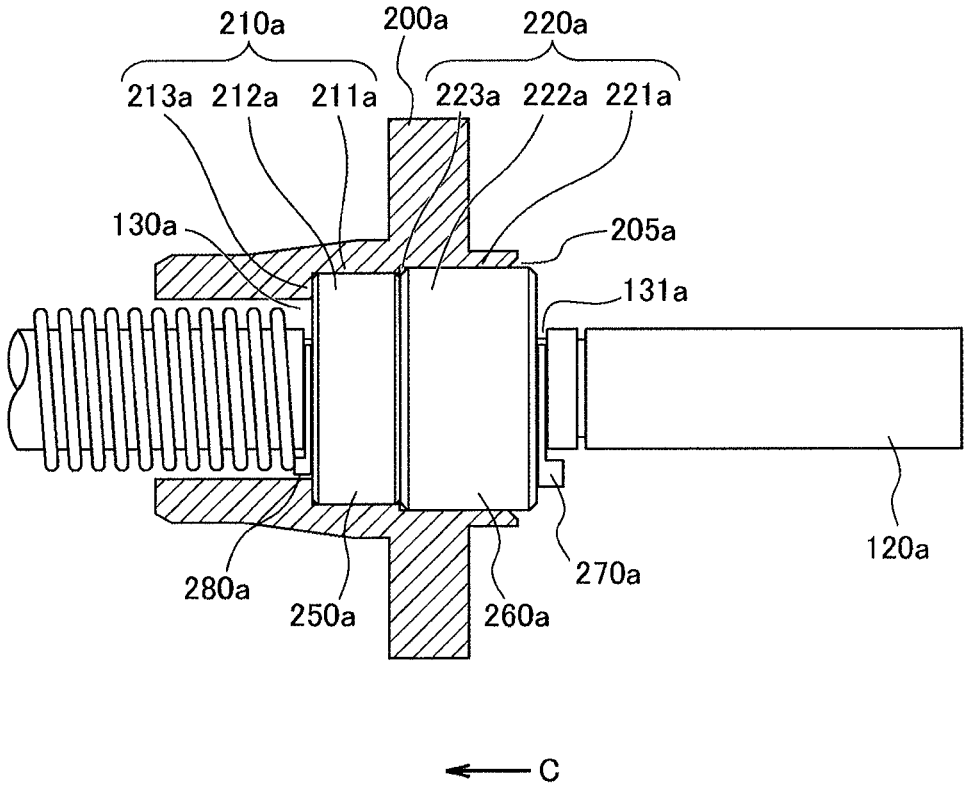
FIG. 7C is a drawing illustrating an attached state in the procedure of attaching to the first holding portion the first bearing in a state where it has been installed to the first shaft member.

Subsequently, as shown in FIG. 7C, by moving further the first bearing 250*a* and the inclination suppression member 260*a* toward the insertion direction C, the first bearing 250*a* is caused to be held in the first holding portion 210*a*, and the inclination suppression member 260*a* is caused to be held in the inclination suppression member holding portion 220*a*.

In this state, the inclination suppression member 260*a* contacts with the first bearing 250*a* and suppresses the inclination of the first bearing 250*a* that has been held in the first holding portion 210*a*.

In addition, in this state, the first bearing 250*a* is held in a state where the rotation of the outer ring portion 253*a* has been regulated by the first holding portion 210*a*. Thereby, the first shaft member 120*a* is held by the first holding portion 210*a* rotatably via the first bearing 250*a*. That is, the photoconductor drum 2*a* is held rotatably by the shaft member holding mechanism 110*a*.

According to the present embodiment, the shaft member holding mechanism 110*a* includes the inclination suppression member 260*a* which can suppress the inclination of the first bearing 250*a* installed to the first shaft member 120*a*. Thereby, when attaching (inserting) the first bearing 250*a* to the first holding portion 210*a*, the shaft member holding mechanism 110*a* can suppress the inclination of the first bearing 250*a*. In addition, the shaft member holding mechanism 110*a* can suppress the inclination of the first bearing 250*a* held in the first holding portion 210*a*.

Furthermore, according to the present embodiment, the inclination suppression member 260*a* is arranged to not contact with the inner ring portion 252*a* in the first bearing 250*a* and to contact with only the outer ring portion 253*a*.

Thereby, the shaft member holding mechanism 110*a* can suppress the inclination of the first bearing 250 as appropriate.

In addition, according to the present embodiment, the inclination suppression member 260*a* is formed so that the maximum inclination in a state where it is solely installed to the first shaft member 120*a* is smaller than the maximum inclination in a state where the first bearing 250*a* is solely installed to the first shaft member 120*a*. In addition, the inclination suppression member 260*a* is configured so that its length in the rotation axis direction J is greater than the length of the first bearing 250*a* in the rotation axis direction J.

Thereby the inclination suppression member 260*a* itself is configured to not incline easily and thus the shaft member holding mechanism 110*a* can suppress the inclination in the first bearing 250 as appropriate.

In addition, according to the present embodiment, the shaft member holding mechanism 110*a* has the first clip 270*a* that suppresses the movement and the inclination of the inclination suppression member 260*a*. Furthermore, the first clip 270*a* is formed so that the ratio of the projection length TL1 which is a length projecting from the surface of the first shaft member 120*a* in the diameter direction K which intersects orthogonally with the rotation axis direction J to the projection length TL2 of the inclination suppression member 260*a* is greater than or equal to 0.5. Thereby, the first clip 270*a* suppresses the inclination of the inclination suppression member 260 as appropriate. In addition, thereby, the inclination of the first bearing 250*a* is suppressed as appropriate.

Furthermore, in the present embodiment, the first bearing 250*a* is inserted into the first insertion space 212*a* by passing through the inclination suppression member insertion space 222*a*. In addition, the first bearing 250*a* is arranged at the first insertion space 212*a* by being inserted into the back side of the insertion space. For this reason, it is difficult to move the first bearing 250*a* with sufficient precision and there are many portions in the above space that act as obstructions during the movement, and thus the first bearing 250*a* is likely to incline from the posture at the time of initial installation. In addition, since the first bearing 250*a* is arranged at the back side of the insertion space, it is also difficult to correct the inclination produced at the first bearing 250*a*.

In the present embodiment, the shaft member holding mechanism 110*a* suppresses the inclination of the first bearing 250*a* that is easily produced at the time of attachment (insertion move) as appropriate in the above case also.

Furthermore, according to the present embodiment, it is possible to provide the photoconductor drum unit 100 having the shaft member holding mechanism 110*a* that has the above advantageous effects. Here, the photoconductor drum unit 100 can suppress the occurrence of the misalignment of the rotation axes in the photoconductor drum 2*a* and the like.

In addition, according to the present embodiment, it is possible to provide the printer 1 (image forming apparatus) including the photoconductor drum unit 100 having the shaft member holding mechanism 110*a* that has the above advantageous effects.

Here, the printer 1 can suppress the occurrence of the misalignment of the image transferred onto the paper T.

Although suitable embodiments of the present invention have been described in the above, the present invention should not be limited to the above-described embodiments and may adopt various forms.

The type of the image forming apparatus of the present invention is not limited in particular, and may be a copier, a printer, a facsimile machine, or a multi-function device of these machines.

The sheet-like transfer material is not limited to paper, and may be a film sheet, for example.

In addition, in the present embodiment, although the first contacting portion 265*a* and the second contacting portion 266*a* are ring shaped and contact the entire surface of the first contacted portion 255*a* and the second contacted portion 256*a*, they are not limited to this.

That is, the first contacting portion 265*a* and the second contacting portion 266*a* may not be a complete ring shape and may have a plurality of concave portions (non-contacting portion, cut off portion) in the circular direction. Furthermore, the first contacting portion 265*a* and the second contacting portion 266*a* may be formed in a projected shape, for example. In this case, it is necessary to provide a plurality of projected shape portions, and it is preferable to provide three or more of them.

In addition, in the present embodiment, the first contacting portion 265*a* and the second contacting portion 266*a* may have first concave portions that are formed in circular shapes into which the first contacted portion 255*a* and the second contacted portion 256*a* are fitted. Furthermore, in contrast, the first contacted portion 255*a* and the second contacted portion 256*a* may have second concave portions that are formed in circular shapes into which the first contacting portion 265*a* and the second contacting portion 266*a* are fitted. In both cases, the first bearing 250*a* and the inclination suppression member 260*a* are coupled into one body. Thereby, it is possible to suppress the increase in the inclination of the first bearing 250*a*. In addition, in this case, even if the inclination inhibition functionalities of the sole inclination suppression member 260*a* are low, it is possible to suppress the inclination of the first bearing 250*a* as appropriate.

What is claimed is:

1. A shaft member holding mechanism comprising:

a shaft member arranged rotatably about a rotation axis;

a bearing that supports the shaft member rotatably, including an outer ring portion, and an inner ring portion that holds the shaft member and is arranged at an inside of the outer ring portion so that the inner ring portion can rotate relatively to the outer ring portion;

a holding member having a bearing holding portion that holds the outer ring portion of the bearing in a state where a rotation of the outer ring portion is regulated; and an inclination suppression member that is arranged at one side of the bearing in a rotation axis direction of the bearing and suppresses the bearing from inclining;

wherein the inclination suppression member is configured to have a smaller inclination with respect to the rotation axis than the bearing; and wherein the inclination suppression member is configured so that a length in the rotation axis direction is greater than a length of the bearing in the rotation axis direction.

2. A photoconductor drum unit comprising:

a shaft member holding mechanism according to claim 1; and a photoconductor drum body arranged at an opposite side of the bearing at the shaft member from the inclination suppression member side.

3. An image forming apparatus comprising:

a photoconductor drum unit according to claim 2;

a transfer portion which transfers a toner image formed on a surface of the photoconductor drum body to a transfer material of a sheet material; and a fixing unit which fixes onto the transfer material the toner image transferred by the transfer portion.

4. A shaft member holding mechanism comprising:

a shaft member arranged rotatably about a rotation axis;

a bearing that supports the shaft member rotatably, including an outer ring portion, and an inner ring portion that holds the shaft member and is arranged at an inside of the outer ring portion so that the inner ring portion can rotate relatively to the outer ring portion;

a holding member having a bearing holding portion that holds the outer ring portion of the bearing in a state where a rotation of the outer ring portion is regulated; and an inclination suppression member that is arranged at one side of the bearing in a rotation axis direction of the bearing and suppresses the bearing from inclining;

wherein the inclination suppression member contacts with the outer ring portion of the bearing but does not contact with the inner ring portion;

wherein the outer ring portion has a contacted portion formed at the inclination suppression member side, and the inclination suppression member has one or a plurality of contacting portions that is formed at the bearing side, projects to the bearing side, and contacts with the contacted portion in the outer ring portion; and wherein the contacting portion has a concave portion in which the contacted portion in the outer ring portion of the bearing fits.

5. A shaft member holding mechanism comprising:

a shaft member arranged rotatably about a rotation axis;

a bearing that supports the shaft member rotatably, including an outer ring portion, and an inner ring portion that holds the shaft member and is arranged at an inside of the outer ring portion so that the inner ring portion can rotate relatively to the outer ring portion;

a holding member having a bearing holding portion that holds the outer ring portion of the bearing in a state where a rotation of the outer ring portion is regulated; and an inclination suppression member that is arranged at one side of the bearing in a rotation axis direction of the bearing and suppresses the bearing from inclining;

wherein the inclination suppression member contacts with the outer ring portion of the bearing but does not contact with the inner ring portion;

wherein the outer ring portion has a contacted portion formed at the inclination suppression member side, and the inclination suppression member has one or a plurality of contacting portions that is formed at the bearing side, projects to the bearing side, and contacts with the contacted portion in the outer ring portion; and wherein the contacted portion has a concave portion in which the contacting portion in the inclination suppression member fits.

6. A shaft member holding mechanism comprising:

a shaft member arranged rotatably about a rotation axis;

a bearing that supports the shaft member rotatably, including an outer ring portion, and an inner ring portion that holds the shaft member and is arranged at an inside of the outer ring portion so that the inner ring portion can rotate relatively to the outer ring portion;

a holding member having a bearing holding portion that holds the outer ring portion of the bearing in a state where a rotation of the outer ring portion is regulated;

an inclination suppression member that is arranged at one side of the bearing in a rotation axis direction of the bearing and suppresses the bearing from inclining; and a regulation member that is arranged at an opposite side of the inclination suppression member from the bearing side and regulates movement of the inclination suppression member in the rotation axis direction, wherein the regulation member has a ratio of a projection length that is a length projecting from a surface of the shaft member in a direction intersecting orthogonally to the rotation axis direction to a projection length of the inclination suppression member that is greater than or equal to 0.5.

7. A shaft member holding mechanism comprising:

a shaft member arranged rotatably about a rotation axis;

a bearing that supports the shaft member rotatably, including an outer ring portion, and an inner ring portion that holds the shaft member and is arranged at an inside of the outer ring portion so that the inner ring portion can rotate relatively to the outer ring portion;

a holding member having a bearing holding portion that holds the outer ring portion of the bearing in a state where a rotation of the outer ring portion is regulated; and an inclination suppression member that is arranged at one side of the bearing in a rotation axis direction of the bearing and suppresses the bearing from inclining;

wherein the holding member includes:

a hollow shaped insertion space that configures the bearing holding portion and is fit into the bearing;

an opening whose inner diameter is greater than or equal to outside diameters of the bearing and the inclination suppression member; and an inclination suppression member insertion space that is formed between the opening and the insertion space so as to connect the opening and the insertion space, has an inner diameter greater than or equal to an inner diameter of the insertion space and smaller than or equal to the inner diameter of the opening, and is arranged to house the inclination suppression member.

8. The shaft member holding mechanism according to claim 7 further comprising:

an end side bearing arranged in proximity to one end of the shaft member, wherein the bearing is arranged at a side of the one end and at a position spaced apart by a predetermined distance from the end side bearing to an inside in the rotation axis direction.

* * * * *